US005338909A

United States Patent [19]

Stanley et al.

[11] Patent Number: 5,338,909

[45] Date of Patent: Aug. 16, 1994

[54] ROCKER-TYPE SUPPORT ASSEMBLY

[75] Inventors: Ronald F. Stanley, Lake Zurich; Ernest E. Soderlund, Elgin, both of Ill.

[73] Assignee: Motorola, Inc., Schaumburg, Ill.

[21] Appl. No.: 937,260

[22] Filed: Aug. 31, 1992

[51] Int. Cl.[5] ..... H01H 3/02

[52] U.S. Cl. ..... 200/339; 200/5 R; 200/553; 200/562; 455/351

[58] Field of Search ..... 200/553, 562, 556, 302.3, 200/339, 293, 295, 17 R, 6 R, 5 R; 455/347, 351 X; 361/837

[56] References Cited

U.S. PATENT DOCUMENTS

| | | | |
|---|---|---|---|
| 2,860,212 | 11/1958 | Stearn | 200/553 X |
| 4,489,297 | 12/1984 | Haydon et al. | 200/553 X |
| 4,837,411 | 6/1989 | Best | 200/339 X |

FOREIGN PATENT DOCUMENTS

| | | | |
|---|---|---|---|
| 2931370 | 2/1981 | Fed. Rep. of Germany | 200/339 |
| 2100518 | 12/1982 | United Kingdom | 200/339 |

*Primary Examiner*—Glenn J. Barrett

*Attorney, Agent, or Firm*—Daniel W. Jeffernbruch; Rolland R. Hackbart; F. John Motsinger

[57] ABSTRACT

A support assembly for supporting two poppel-type actuation switches at a housing, such as a radiotelephone handset housing. The actuation switches are positioned beneath a support body of the support assembly and maintained in a desired orientation relative to such support body by pawl arms which extend beneath the support body. Post members extend beneath the support body to abut against membranes of the respective actuation switches. The support body is affixed to the housing by way of retaining arms positioned to extend beneath the support body midway along the length thereof while permitting limited pivotal movement about rocker arms positioned at sides of the support body responsive to twisting moments applied to the support body. The twisting moments applied to the support body are transmitted to the poppel-type switches by way of the post members form the actuation forces to actuate the poppel-type switches supported thereat.

22 Claims, 5 Drawing Sheets

ROCKER-TYPE SUPPORT ASSEMBLY

BACKGROUND OF THE INVENTION

The present invention relates generally to support assemblies, and, more particularly, to a rocker-type support assembly for supporting an actuation switch actuatable responsive to application an actuation force upon a face surface thereof.

A communication system is operative to transmit information between two or more locations, and includes, at a minimum, a transmitter and a receiver interconnected by a communication channel. A radio communication system is a communication system in which the communication channel comprises a radio frequency channel wherein a radio frequency channel is defined by a range of frequencies of the communication spectrum.

The transmitter which forms a portion of the radio communication system includes circuitry for converting the information into a form suitable for transmission thereof upon a radio frequency channel. Such circuitry includes modulation circuitry which performs a process referred to as modulation. In such a process, the information which is to be transmitted is impressed upon a radio frequency electromagnetic wave, commonly referred to as a carrier signal. The resultant signal, formed of a combination of the carrier signal and the information, is commonly referred to as a modulated signal. Such resultant signal is also referred to as a communication signal as the modulated signal includes the information which is to be communicated between the transmitter and the receiver.

Various modulation schemes are known for impressing the information upon the carrier signal to form thereby the communication signal. For instance, amplitude modulation, frequency modulation, phase modulation, and combinations thereof are all modulation schemes by which information may be impressed upon a carrier wave to form the communication signal.

Radio communication systems are advantageous in that no physical interconnection is required between the transmitter and the receiver; once the information signal is modulated to form a modulated signal, the modulated signal may be transmitted over large distances.

Additionally, numerous modulated signals may be simultaneously transmitted at different frequencies of the electromagnetic frequency spectrum. Transmission of communication signals on frequency channels defined upon certain frequency bands of the electromagnetic frequency spectrum is regulated by regulatory bodies.

A two-way, radio communication system is a radio communication system, similar to the radio communication system above-described, but which further permits both transmission of information to a location, and transmission of information from that location. Each location of such two-way radio communication system contains both a transmitter and a receiver. The transmitter and the receiver positioned at a single location typically comprise a unit referred to as a radio transceiver, or, more simply, a transceiver.

A cellular communication system is one type of two-way radio communication system in which communication is permitted with a radio transceiver positioned at any location within a geographic area encompassed by the cellular communication system.

A cellular communication system is created by positioning a plurality of fixed-site radio transceivers, referred to as base stations, at spaced-apart locations throughout the geographic area. The base stations are connected to a conventional, wireline, telephonic network. Each base station has associated therewith a portion of the geographic area located proximate to each of such base stations. Such portions are referred to as cells. The plurality of cells, each defined by corresponding ones of the base stations of the plurality of base stations together define the coverage area of the cellular communication system.

A radio transceiver, referred to in a cellular communication system as a radiotelephone, positioned at any location within the coverage area of the cellular communication system is able to communicate with a user of the conventional, wireline, telephonic network by way of a base station. Modulated signals are transmitted between the radiotelephone and the base station to effectuate communication therebetween.

Typically, the radiotelephone includes a handset assembly operative in a manner analogous to the operation of a handset assembly of conventional telephonic apparatus.

In some radiotelephone constructions, only portions of the circuitry of the radiotelephones are disposed within the handset assembly. In such constructions, the handset assembly is coupled to transceiver circuitry housed within other structure. In other radiotelephone constructions, the entire circuitry of the radiotelephones are housed within the handset assembly.

In either type of radiotelephone construction, however, the handset assembly includes structure to facilitate operation of the radiotelephone. As such structure permits (or requires) the interaction of a user, such structure is typically referred to as a user interface.

For instance, the handset assembly of either type of radiotelephone includes a user interface which permits the user to effectuate telephonic communication by way of the radiotelephone with a remote site. Such user interface typically comprises a telephonic keypad to permit the user to enter a desired call sequence (i.e., a telephone number) thereby to effectuate telephonic communication with a location associated with such call sequence.

A user interface which is sometimes also disposed upon the handset assembly is a volume control element. Such volume control permits alteration of the amount of amplification of a signal generated at the earpiece speaker of the handset. Alteration of such amplification level of the signal applied to the earpiece speaker of the handset assembly is, of course, determinative of the magnitude of the aural signal generated by the earpiece speaker.

In many instances, the user of the radiotelephone operates the radiotelephone (and the user interfaces of such radiotelephone) while also simultaneously operating an automotive vehicle. According, any user interface on the radiotelephone must be easily accessible and easily operated by the user.

In some conventional designs of radiotelephones, the user interface utilized for volume control includes a poppel-type actuation switch. A poppel-type actuation switch is a momentary action switch, and is actuatable responsive to application of an actuation force upon a face surface thereof.

The poppel-type switch includes a conductive, semi-spherical membrane which is deformed responsive to the application of the actuation force to the face surface of the actuation switch. Deformation of the membrane causes the membrane to contact with switch contacts, thereby to close the switch for so long as the actuation force is continued to be applied thereto.

To operate properly, a poppel-type actuation switch must be suitably mounted or otherwise supported such that application of the actuation force to the face surface thereof actuates the switch. If the switch is not properly supported or mounted, the entire switch is susceptible to translation responsive to actuation of the actuation switch instead of the desired deformation of the conductive membrane.

Accordingly, radiotelephone constructions having a user interface formed of a poppel-type actuation switch must include support structure to prevent translation of the switch upon application of the actuation force thereto. At the same time, such structure must permit easy access by the user to the switch to permit the user to actuate the switch.

Inherent in user interfaces permitting of volume control, is the ability to vary the magnitude of the aural signal both to increase and to decrease such magnitude. Use of a poppel-type actuation switch for purposes of volume control, therefore, necessitates the use of two poppel-type actuation switches. A first of the actuation switches is operative to increase the volume of a device, and a second of the actuation switches is operative to decrease the volume of the device. Each of such actuation switches must, of course, be properly supported or otherwise mounted to permit proper operation of such switches.

As radiotelephones are typically produced in commercial quantities, the radiotelephones are usually assembled in an assembly line-like process. Components of such radiotelephones must be of designs facilitating their assembly in such a process.

To date, poppel-type switches utilized to form a user interface on a radiotelephone handset have only been assembled during assembly of the radiotelephone with some difficulty as such switches must be carefully mounted to ensure their proper operation.

What is needed, therefore, is apparatus for supporting a poppel-type actuation switch such that an actuation force, when applied to the face surfaces of the actuation switch causes actuation of such switch.

What is further needed is apparatus for supporting a poppel-type actuation switch when used as a user interface of electronic circuitry, such as a radiotelephone.

What is yet further needed is apparatus for supporting poppel-type actuation switches utilized as a volume-control, user interface of a radiotelephone which may be easily and quickly assembled during assembly of the radiotelephone.

SUMMARY OF THE INVENTION

The present invention, accordingly, advantageously provides apparatus for supporting an actuation switch actuatable responsive to application of an actuation force upon a face surface thereof, such as a poppel-type, actuation switch, such that the actuation force, when applied to the face surface of the actuation switch, causes actuation of such switch.

The present invention further advantageously provides apparatus for properly supporting such an actuation switch when used as a user interface of electronic circuitry, such as a radiotelephone.

The present invention yet further advantageously provides apparatus for supporting such actuation switches utilized as a volume-control, user interface of a radiotelephone which may be quickly and easily assembled during assembly of the radiotelephone.

The present invention provides further advantages and features, the details of which will become more apparent when reading the following detailed description of the preferred embodiments.

In accordance with the present invention, therefore, a rocker-type support assembly for supporting at least one actuation switch actuatable responsive to application of an actuation force upon a face surface thereof is disclosed. The rocker-type support assembly is mountable at a receiving surface defined upon a substrate of a predefined thickness and has an opening extending between a top side surface and a bottom surface thereof. The receiving surface is formed of portions of the top side surface of the substrate about the opening extending through the substrate. The support assembly comprises a support body defining a top face surface, a bottom face surface, and side edge surfaces. The bottom face surface of the support body is of dimensions permitting positioning of the at least one actuation switch therebeneath. The at least one actuation switch is maintained in a desired orientation relative to the support body. The support body is affixed to the receiving surface while permitting limited rocking movement of the support body thereabout upon application of a twisting moment to the support body. The twisting moment, applied to the support body to cause the pivotal movement thereof results in an actuation force applied to the face surface of the actuation switch to actuate the actuation switch responsive to such pivotal movement of the support body.

BRIEF DESCRIPTION OF THE DRAWINGS

The present invention will be better understood when read in light of the accompanying drawings in which.

DESCRIPTION OF THE PREFERRED EMBODIMENTS

Figure 1:
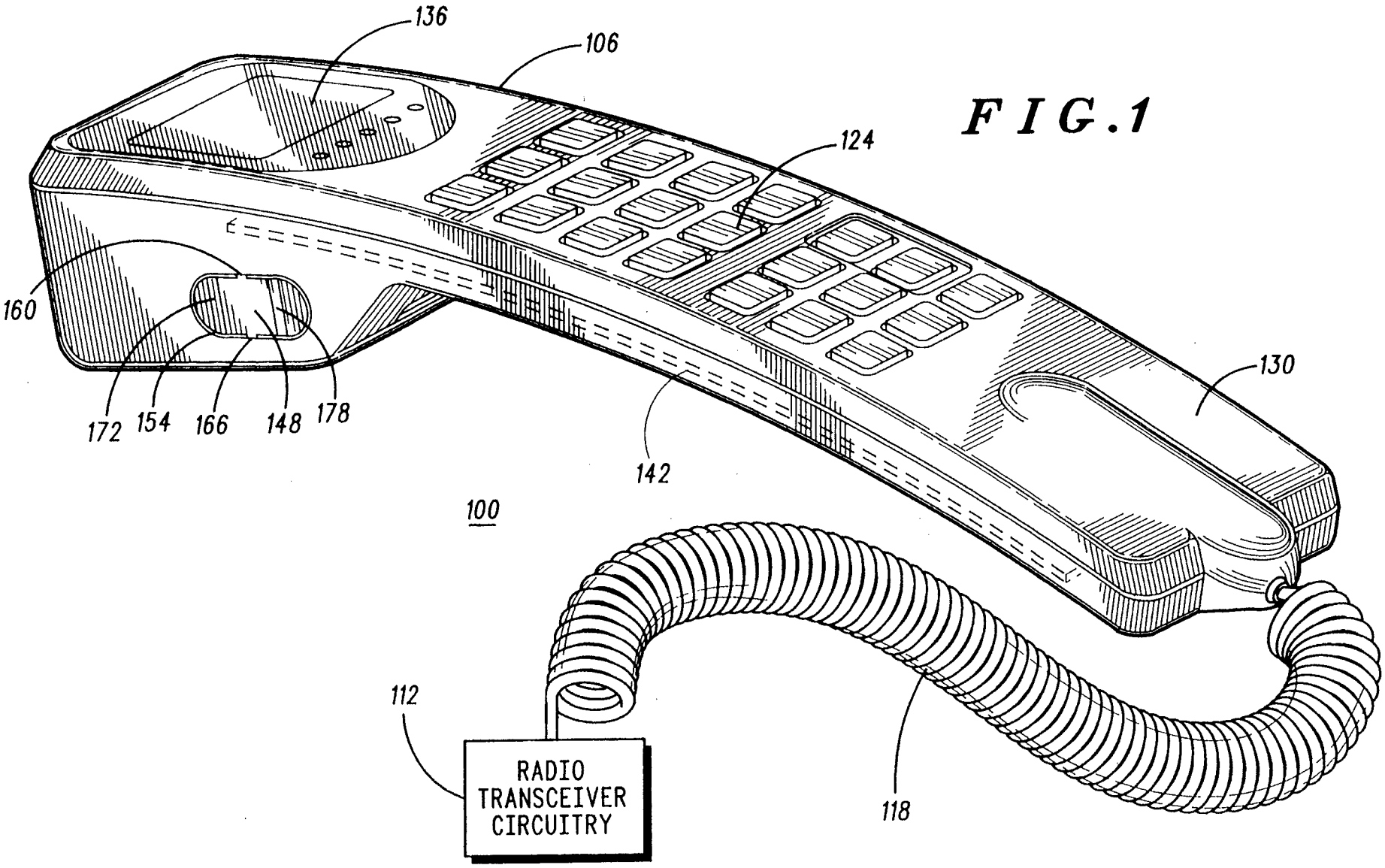
FIG. 1 is a partial-perspective, partial-block diagram of a radiotelephone to which the support assembly of the preferred embodiment of the present invention may be affixed.

Referring first to the partial perspective, partial block diagram of FIG. 1, a radiotelephone, referred to generally by reference numeral 100, is shown. Radiotelephone 100 is comprised of handset 106 and radio transceiver circuitry 112. Handset 106 and circuitry 112 are interconnected by electrical cable 118. Handset 106, analogous to the handset of conventional telephonic apparatus, is comprised of an outer housing which supports an earphone speaker (not shown in the view of the figure) at one end portion of the housing and a microphone (also not shown in the view of the figure) disposed at an opposing end portion of the housing.

Keypad assembly 124 is disposed upon face surface 130 of handset 106. Keypad assembly 124 is operative in conventional manner to permit a user to enter a call sequence corresponding to a telephone number to effectuate communication with a remote site. Display element 136 is further disposed on face surface 130.

Circuit board 142, shown in hatch in the figure, is housed within the housing of handset 106. In the embodiment of FIG. 1, the circuitry disposed upon circuit board 142 is connected by way of cable 118 to radio transceiver circuitry 112. It should be noted, however, and as noted briefly hereinabove, that in other radiotelephone constructions, the entire circuitry of the radiotelephone is housed within handset 106.

Opening 148 is formed through the housing of handset 106, here at a side portion of the housing of handset 106. Opening 148 extends the entire distance between the outer side surface of the housing (such surface is shown in the figure) and an interior, side surface (such interior, side surface is hidden from view in the figure). The distance between the outer side surface of the housing and the interior side surface of the housing defines the thickness of the housing.

The portion of the housing of handset 106 positioned immediately about opening 148 is two-tiered in configuration thereby to define inner lip 154 about the circumference of opening 148. Inner lip 154 forms a seating surface for purposes to be noted below. Gaps 160 and 166 are formed at opposing sides of inner lip 154.

Joists 172 and 178 extend across opening 148 to span opposing sides of the housing of the handset. Joists 172 and 178 are spaced a predetermined distance beneath the interior side surface of the housing of handset 106, and, hence, also a predetermined distance beneath the seating surface formed of inner lip 154 (as well as, also, a predetermined distance beneath the outer sidewall surface of the housing).

As will be noted in more detail hereinbelow, the support assembly of the preferred embodiment of the present invention is inserted into opening 148 and actuation switches supported by such support assembly are electrically connected to circuitry housed within the housing of handset 106, such circuitry here being represented by circuit board 142.

Figure 2:
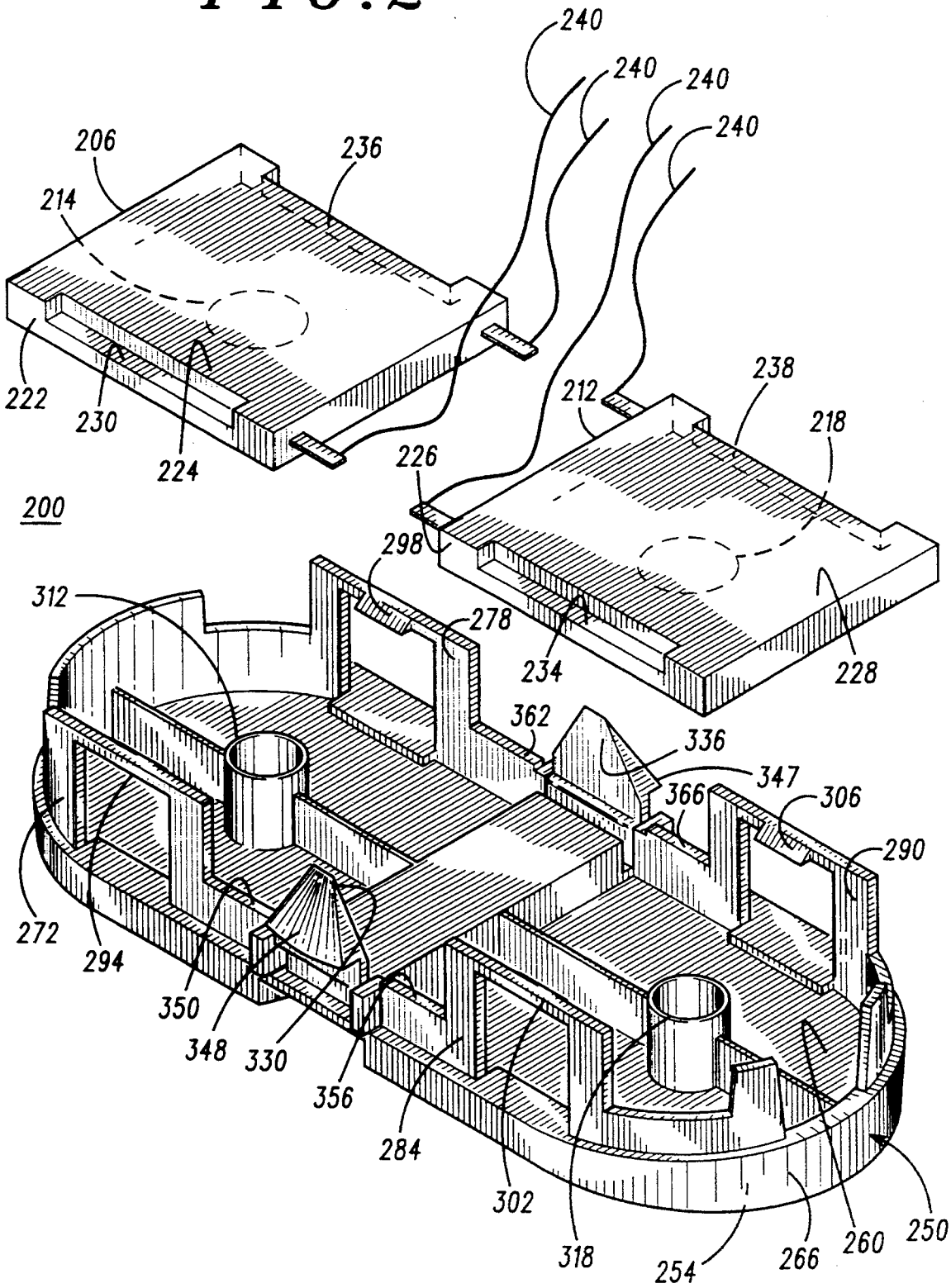
FIG. 2 is an exploded, perspective view of the support assembly of the preferred embodiment of the present invention positioned to receive poppel-type actuation switches to be supported thereat.

Turning next to the exploded, perspective view of FIG. 2, the support assembly, referred to generally by reference numeral 200, of the preferred embodiment of the present invention is shown. Pictured above support assembly 200 are poppel-type actuation switches 206 and 212.

As mentioned previously, switches 206 and 212 include deformable membranes which deform responsive to application of an actuation force thereto. Such membranes are operative to close the switches to actuate the switches thereby during times in which the actuation force is applied to deform such membranes. Actuation switches 206 and 212 include openings, here indicated by circles 214 and 218, shown in hatch, upon bottom face surfaces of switches 206 and 212, respectively. Such openings permit an externally-generated actuation force to be applied to the membranes housed within respective ones of the switches 206 and 212.

A notch is formed at the intersection of side surface 222 and top face surface 224 of switch 206. Similarly, a notch is formed at the intersection of side surface 226 and top face surface 228. Seating surfaces are formed of such notches and are identified in the figure by reference numerals 230 and 234. Notches similarly form seating surfaces at side surfaces of switches 206 and 212 opposing those of side surfaces 222 and 226. Such seating surfaces are identified in the figure by reference numerals 236 and 238.

Switches 206 and 212 are further shown to include connecting cables extending therefrom; such connecting cables are referred to in the figure by the common reference numeral 240.

Support assembly 200 is formed of a support body 250 which defines top face surface 254, bottom face surface 260, and side edge surface 266 extending about a perimeter of support body 250. In the preferred embodiment, support body 250 is comprised of a thermoplastic material. Support body 250 is of dimensions corresponding to the dimensions of opening 148 extending through the housing 106 of FIG. 1.

Extending beyond face surface 260 of support body 250 at opposing side edge surfaces 266 thereof are pawl arms 272, 278,284, and 290. As illustrated, pawl arms 272 through 290 are U-shaped in configuration. Ends of opposing side legs of the U-shaped pawl arms 272 through 290 are affixed to support body 250. Formed to extend outwardly beyond the interconnecting legs of the respective ones of pawl arms 272 through 290 are hooked-portions 294, 298,302, and 306.

Pawl arms 272 through 290 are comprised of a flexible material to permit thereby flexing of such pawl arms upon application of bending forces applied thereto and, in the preferred embodiment, are integrally formed with the support body to be of the same thermoplastic material of which support body 250 is comprised.

Hooked portions 294 through 306 are of dimensions permitting engagement of such portions 294 through 306 with seating surfaces, including seating surfaces 230 and 234, formed upon the opposing sidewalls of switches 206 and 212. For instance, hooked portion 294 is of dimensions permitting seating thereof against seating surface 230 of switch 206, and, hooked portion 302 is of dimensions permitting seating thereof upon seating surface 234 of switch 212.

Each of the hooked portions 294 through 306 include angled, top face surfaces leading to back-angled seating surfaces which, in the preferred embodiment, extend at angles such that the seating surfaces formed thereof extend in planes parallel to the planar direction defined by face surface 260 of support body 250.

Pawl arms 272 and 278 and pawl arms 284 and 290 are spaced apart by distances corresponding to widths of switches 206 and 212.

By aligning switches 206 and 212 to center such switches between the pairs of pawl arms 272 and 278 and 284 and 290, respectively, and then lowering such switches 206 and 212 towards such pairs of pawl arms 272–278 and 284–290, opposing sides of the switches 206 and 212 (including sidewalls surfaces 222 and 226 of switches 206 and 212, respectively) abut against the angled, top face surfaces of hooked portions 294–298 and 302–306 of the respective pairs of pawl arms 272 through 290. Such abutting engagement causes bending forces to be exerted upon each of the pawl arms 272 through 290.

Such bending forces cause flexing of the pawl arms thereby to permit continued translation of the switches 206 and 212. Continued translation of switches 206 and 212 results in the seating surfaces 230 and 236 of switch 206 and seating surfaces 234 and 238 of switch 212 to be aligned with the seating surfaces formed of the backangled portions of hooked portions 294, 298, 302, and 306. At such point, bending forces are no longer exerted upon the pairs of pawl arms 272–278 and 284–290, and the pawl arms return to an unstressed position. The seating surfaces formed of the back-angled portions of hooked portions 294–298 and 302–306 of the pairs of pawl arms 272–278 and 284–290 are then aligned with the seating surfaces formed upon the sidewalls of switches 206 and 212.

Hooked portions 294–298 and 302–306 of the pairs of pawl arms 272–278 and 284–290 are thereby operative to maintain switches 206 and 212 within a predetermined distance of face surface 260 of support body 250. The magnitude of such predetermined distance is determined by the elevation at which hooked portions 294–298 and 302–306 are positioned above face surface 260.

Further formed to extend beyond face surface 260 of support body 250 are post members 312 and 318. Post members 312 and 318 are tubular-shaped in configuration having diameters corresponding to, but slightly less than the diameters of openings 214 and 218 formed through face surfaces of switches 206 and 212, respectively. Post members 312 and 318 are of lengths such that top, end surfaces thereof are at elevations above face surface 260 of support body 250 corresponding to the elevations above face surface 260 at which back-angled portions of hooked portions 294–298 and 302–306 of the pairs of pawl arms 272–278 and 284–290, respectively, less the distance above bottom face surfaces of switches 206 and 212 at which the seating surfaces such as seating surfaces 230 and 236 and 234 and 238 formed in the sidewalls of switches 206 and 212, respectively, are located. Accordingly, the elevations at which the top end surfaces of post members 312 and 318 are located above face surface 260 are somewhat less than the elevation at which the backangled portions of hooked portions 294–298 and 302–306 are located beyond face surface 260.

Because of the differences in elevation of top end surfaces of post members 312 and 318 relative to the elevations of back-angled portions of hooked portions 294–298 and 302–306, when switches 206 and 212 are lowered into engagement with hooked portions 294–298 and 302–306 of the pairs of pawl arms 272–278 and 284–290, switches 206 and 212 abut against post members 312 and 318, respectively, at the same time in which the seating surfaces formed upon the opposing sidewalls of switches 206 and 212 align with corresponding seating surfaces of hooked portions 294–298 and 302–306. Accordingly, while pawl arms 272–278 and 284–290 maintain switches 206 and 212 within a predetermined maximum distance beyond face surface 260 of support body 250, post members 312 and 318 maintain switches 206 and 212, respectively, beyond a minimum distance beyond face surface 260 of support body 250.

Because the diameters of post members 312 and 318 are less than the diameters of openings of 214 and 218 of switches 206 and 212, respectively, the top, end surfaces of post members 312 and 318 extend through openings 214 and 218, respectively, to abut against the membranes positioned within switches 206 and 212.

Still further formed to extend beyond face surface 260 of support body 250 at opposing portions of side edge surface 266 thereof are retaining arms 330 and 336. Retaining arms 330 and 336 are positioned at opposing sides of support body 250 to form a pair of retaining arms located midway along the length of support body 250. Retaining arms 330 and 336 are preferably integrally formed with support body 250 to be comprised of the same thermoplastic material as that of support body 250.

Retaining arms 330 and 336 are spike-shaped having angled, face surfaces which lead to back-angled surfaces formed of central bight sections of the retaining arms. Retaining arms 330 and 336 further include shaft portions extending between face surface 260 and the central bight sections of the respective retaining arms. Retaining arms 330 and 336 are also somewhat flexible to permit limited bending thereof. (While, in the preferred embodiment, support body 250, pawl arms 272 through 290, and retaining arms 330–336 are all comprised of a similar material, the varying thicknesses of the various elements are determinative of the flexibility of such elements.)

The shaft portions of retaining arms 330 and 336 are of lengths corresponding to, but slightly greater than, the thickness of the housing forming handset 106 of FIG. 1 about opening 148. And, as noted previously, support body 250 is of dimensions corresponding to the dimensions of opening 148 extending through the housing of handset 106; as retaining arms 330 and 336 extend beyond opposing sides of support body 250, retaining arms 330 and 336 are separated by distances corresponding to the width of opening 148 extending through the housing of handset 106.

Further formed to extend beyond face surface 260 of support body 250 are rocker arms 350,356,362, 366. Rocker arms 350 and 356 are positioned at opposing sides of the shaft portion of retaining arm 330, and rocker arms 362 and 366 are disposed at opposing sides of the shaft portion of retaining arm 336. Rocker arms 350 through 366 are of lengths slightly less than the lengths of the shaft portions of the retaining arms, and include rounded, end surfaces.

Retaining arms 330 and 336 are operative to affix support body 250, in the preferred embodiment, to the housing of handset 106 when the support assembly 200 is inserted to extend into opening 148 of the handset. Proper alignment of support assembly 200 at opening 148 aligns retaining arms 330 and 336 with gaps 160 and 166 formed about inner lip 154.

Translation of support assembly 200 into opening 148 against angled surfaces 347 and 348 formed upon retaining arms 330 and 336 causes bending forces to be applied against retaining arms 330 and 336 when the retaining arms cam into sides of the housing to cause bending of such retaining arms. Once support assembly 200 is inserted into opening 148 such that the spiked-end portions (i.e., angled surfaces 347 and 348) of the retaining arms 330 and 336 extend entirely through opening 148, the back-angled face surfaces of the retaining arms are positioned beneath the housing of the handset. At such point, bending forces are no longer exerted upon retaining arms 330 and 336, and bending moments are no longer applied to the retaining arms. Accordingly, retaining arms 330 and 336 return to unstressed positions, thereby to affix support assembly 200 against surface 154 of handset 106.

Because the shaft portions of retaining arms 330 and 336 are slightly greater than the thickness of the housing, limited pivotal movement of support body 250 is permitted when support assembly 200 is affixed to handset 106.

Because of the relative differences between the heights of rocker arms 350 through 366 and handset 106, once support assembly 200 is translated into opening 148 to position the hooked projection portion of the retaining arms 330 and 336 within the housing of handset 106 such that the back-angled face surfaces of the retaining arms are positioned to abut against inner wall surfaces of the housing of the handset, the rounded end portions of rocker arms 350 through 366 seat against inner lip 154. When positioned in such manner, a twisting moment applied to top face surface 254 of support body 250 results in limited pivotal movement of the support body 250 about a fulcrum defined by either rocker arms 350 and 362 or rocker arms 356 and 366. Pivotal movement of the support body is, however, limited by joists 172 and 178 of handset 106.

Such pivotal movement of support assembly 200, once mounted at opening 148 causes a rear face surface of switch 206 or 212 to abut against joists 172 and 178, respectively.

Continued application of a twisting moment to support body 250 post member 312 or 318 to extend through opening 214 or 218 of switch 206 or 212, respectively, thereby to engage with the membrane located within the respective switch, and thereby to provide the actuation force to actuate the switch.

Figure 3:
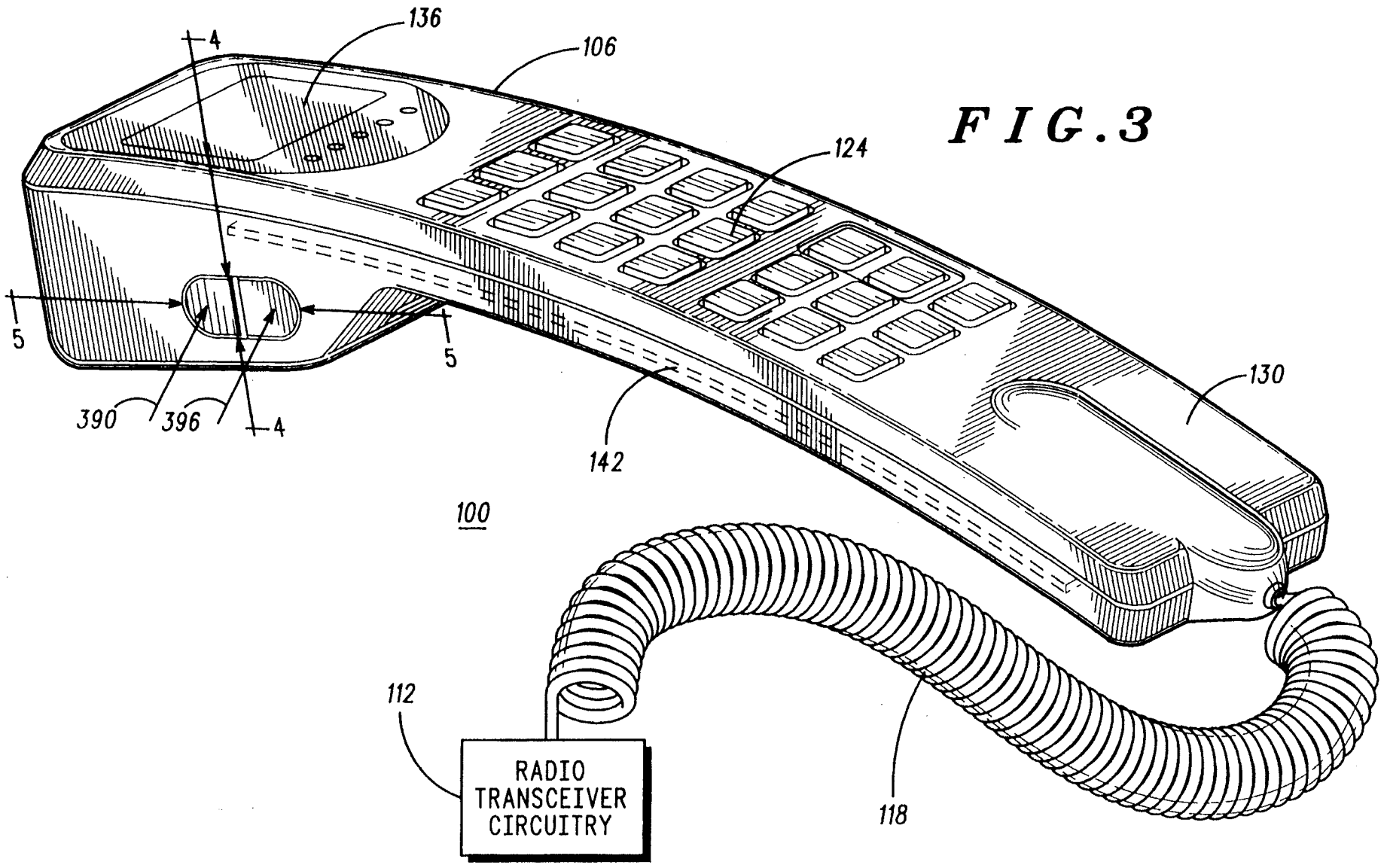
FIG. 3 is a partial-perspective, partial-block view, similar to that of FIG. 1, but wherein the support assembly of FIG. 2 is affixed to the handset portion of the radiotelephone.

FIG. 3 is a partial perspective, partial block view of radiotelephone 100 shown previously in FIG. 1, but here illustrated once support assembly 200 has been inserted into opening 148 formed to extend through the housing of handset 106. The remaining portions of radiotelephone 100 are identical to those previously shown in FIG. 1 and described in relation thereto, and such structure will not again be described in detail.

Arrows 390 and 396 are further illustrated in the figure. Arrows 390 and 396 are representative of twisting moments applied to face surface 254 of support body 250. The twisting moments generated in a direction indicated by arrow 390 causes clockwise pivotal movement of the support body; conversely, a twisting moment applied to the support body in the direction indicated by arrow 396 causes pivotal movement of the support body in a counter-clockwise direction. The amount of such pivotal movement is, again, limited by the joists 172 and 178 positioned beneath support assembly 200. The twisting moments applied in the directions indicated by arrows 390 and 396 cause alternate actuation of actuation switches 206 or 212 positioned beneath the support body 250.

Figure 4:
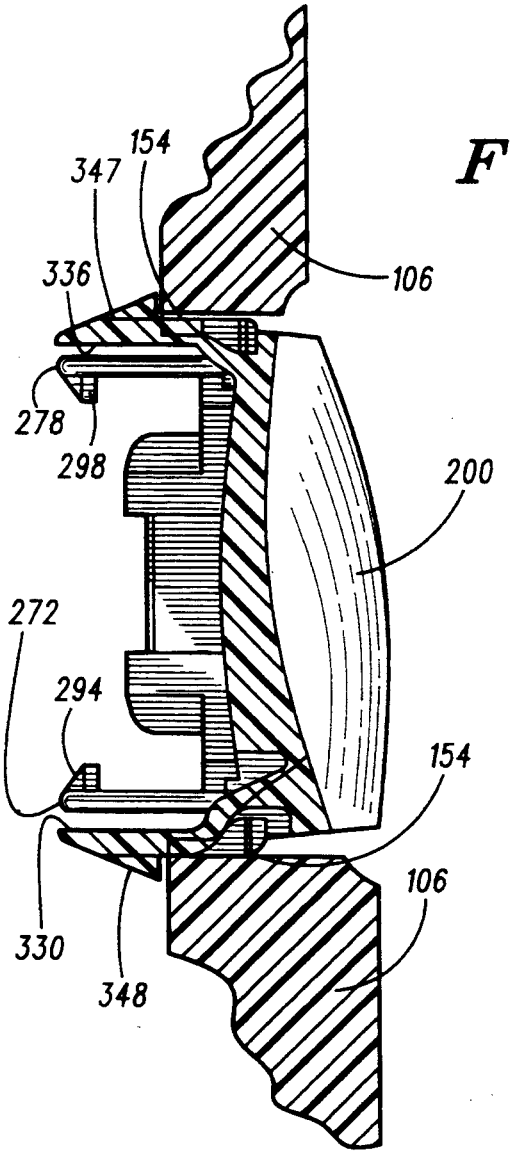
FIG. 4 is a sectional view taken along lines IV—IV of FIG. 3.

FIG. 4 is a sectional view taken through radiotelephone 100 of FIG. 3 along lines IV—IV. The sectional view of FIG. 4 best illustrates the relationship between retaining arms 330 and 336 and the housing of handset 106. When support assembly 200 is inserted into opening 148 such that the hooked projecting portions of the respective retaining arms 330 and 336 are positioned wholly within the housing of handset 106, perpendicular flats of back-angled portions of retaining arms 330 and 336 seat against an inner side surface of the housing of handset 106, thereby to affix support assembly 200 in position at opening 148. Inner lip 154, which extends about the periphery of opening 148, is further shown in the figure.

Figure 5:
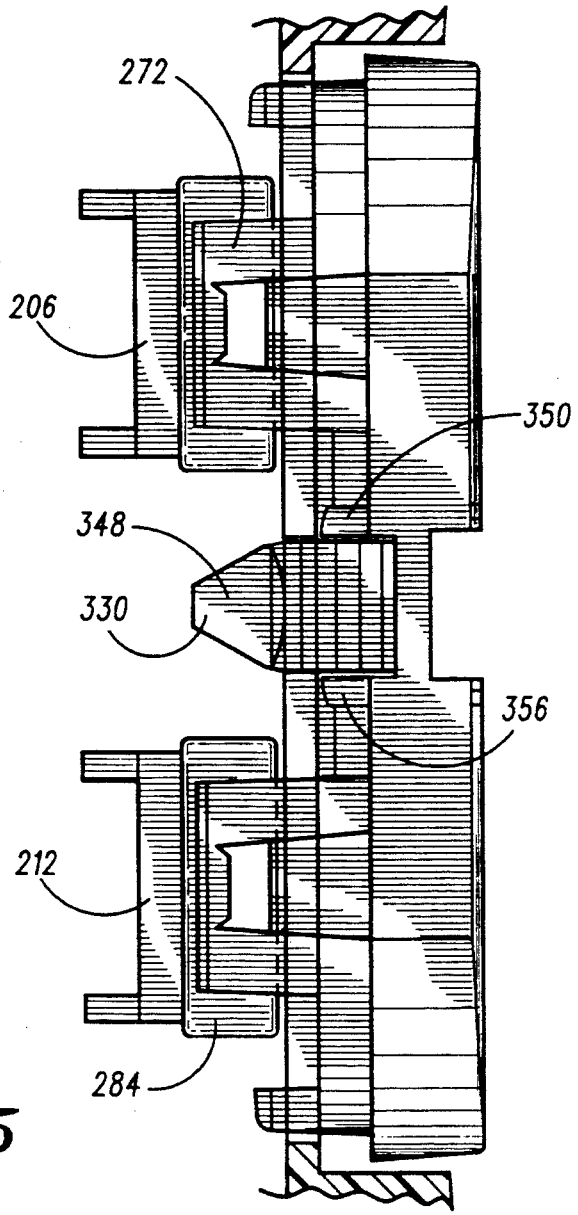
FIG. 5 is a sectional view taken through lines V—V of FIG. 3.

FIG. 5 is a sectional view taken through handset 106 of radiotelephone 100 of FIG. 3 along line V—V. The relationship between rocker arms 350 and 362 and inner lip 154 positioned about a periphery of opening 148. Application of a twisting moment along the length of support body 250 results in limited pivotal movement of the support body about a fulcrum defined by a pair of rocker arms, including, alternately, rocker arm 350 (and, while not shown in FIG. 5, also rocker arm 362) and rocker arm 356 (and, while not shown in FIG. 5, also rocker arm 366).

Because actuation switches 206 and 212 may be affixed to support assembly 200 merely by aligning the respective ones of the switches with the pairs of pawl arms 272–278 and 284–290, and then lowering the actuation switches to engage the actuation switches with the pairs of pawl arms, the actuation switches may be easily supported by support assembly 200. Once the actuation switches have been affixed to the support assembly, the support assembly may then be easily affixed to the housing of handset 106 by merely inserting support assembly 200 into the opening 148 extending through the housing of handset 106. Actuation of either switch 206 or 212 is effectuated by merely applying a force in directions indicated by arrows 390 or 396 to face surface 254 of support body 250.

Figure 6:
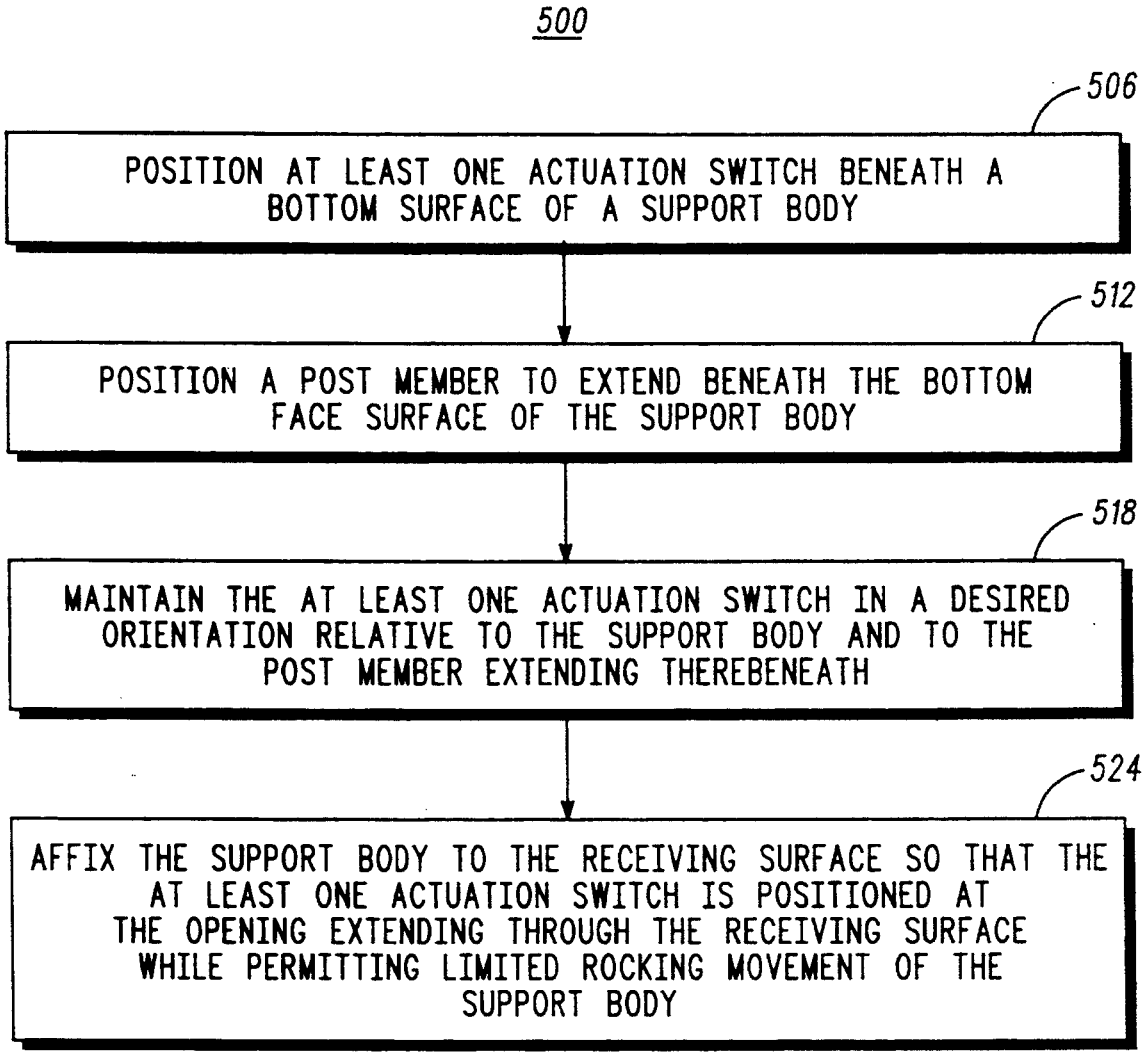
FIG. 6 is a logical flow diagram listing the method steps of the method of the preferred embodiment of the present invention.

Turning finally now to the logical flow diagram of FIG. 6, the method steps of the method, referred to generally by reference numeral 500, of the preferred embodiment of the present invention are listed.

First, and as indicated in block 506, at least one actuation switch is positioned beneath a bottom surface of a support body. Next, and as indicated in block 512, a post member is positioned to extend beneath the bottom face surface of the support body such that a bottom end surface of the post member abuts against the face surface of the at least one actuation switch.

Next, and as indicated in block 518, the at least one actuation switch is maintained in a desired orientation relative to the support body and to the post member extending therebeneath. Finally, and indicated within block 524, the support body is affixed to the receiving surface such that the at least one actuation switch is positioned at the opening extending through the receiving surface while permitting limited rocking movement of the support body responsive to application of a twisting moment thereto. The rocking movement is operative to cause the post member to engage with the at least one actuation switch to provide the actuation switch with the actuation force to actuate the actuation switch thereby.

While the present invention has been described in connection with the preferred embodiments shown in the various figures, it is to be understood that other similar embodiments may be used and modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. A rocker support assembly for supporting at least one actuation switch, said at least one actuation switch being responsive to application of an actuation force upon a face surface thereof, said rocker support assembly being mountable at a receiving surface defined upon a substrate of a predefined thickness and having an opening extending between a top side surface and a bottom side surface thereof, the receiving surface being formed from portions of the top side surface of the substrate about the opening extending through the substrate, said rocker support assembly comprising:

a support body defining a top face surface, a bottom face surface and side edge surfaces, the bottom face surface of said support body having dimensions adapted for permitting positioning of the at least one actuation switch beneath said bottom face surface means extending from the support body beneath the bottom face surface and being engageable with the at least one actuation switch for maintaining the at least one actuation switch in a desired orientation relative to the support body;

means, extending from the support body beneath the bottom face surface of the support body and being engageable with the receiving surface for affixing the support body to the receiving surface while permitting limited rocking movement of the support body thereabout upon application of a twisting moment to the support body; and means coupled to and extending beneath the bottom face surface of the support body for engaging with the face surface of the actuation switch, said means for engaging being operative to abut against the face surface of the actuation switch and to generate the actuation force to actuate the actuation switch responsive to times in which the twisting moment applied to the support body causes pivotal movement thereof in a first direction.

2. The rocker-type support assembly of claim 1 wherein said support body, said means for maintaining, said means for affixing, and said means for engaging are all integrally formed.

3. The rocker-type support assembly of claim 1 wherein the bottom face surface of said support body having dimensions adapted for permitting positioning beneath said bottom face surface a first actuation switch and a second actuation switch, whereby the first and second actuation switches, respectively, being positioned side-by-side.

4. The rocker-type support assembly of claim 3 wherein the first and second actuation switches are separated by said means for affixing.

5. The rocker-type support assembly of claim 1 wherein said means for maintaining comprises at least one pawl arm extending beneath a side edge surface of the support body,

6. The rocker-type support assembly of claim 5 wherein said at least one pawl arm comprises first and second pawl arms forming a pair of pawl arms extending beneath opposing side edge surfaces of the support body.

7. The rocker-type support assembly of claim 5 wherein said at least one pawl arm maintains the at least one actuation switch within a predetermined maximum distance beneath the bottom face surface of the support body.

8. The rocker-type support assembly of claim 7 wherein said at least one pawl arm further comprises a hooked-end portion adapted for engaging with a side surface of the at least one actuation switch.

9. The rocker-type support assembly of claim 8 wherein said at least one pawl arm is comprised of a flexible material thereby to permit bending thereof upon engagement with the side surface of the at least one actuation switch and to position the hooked-end portion of the at least one pawl arm in hooked engagement with the side surface of the at least one actuation switch.

10. The rocker-type support assembly of claim 1 wherein said means for affixing comprises at least one retaining arm extending beneath a side edge surface of the support body.

11. The rocker-type support assembly of claim 10 wherein said at least one retaining arm comprises first and second retaining arms forming a pair of retaining arms extending beneath opposing side edge surfaces of the support body.

12. The rocker-type support assembly of claim 10 wherein said at least one retaining arm extends beneath the side edge surface of the support arm at a location midway along the support body.

13. The rocker-type support assembly of claim 10 wherein said at least one retaining arm is comprised of a shaft portion affixed at a top end thereof to the bottom face surface of the support surface, a central bight section formed along a bottom end portion of the shaft portion and a hooked projection having a latching surface extending beyond the central bight section.

14. The rocker-type support assembly of claim 13 wherein the shaft portion extends beneath the bottom face surface by a length corresponding to, but slightly greater then, the predefined thickness of the receiving surface, and is comprised of a flexible material to permit bending thereof upon engagement thereof with a top side of the receiving surface and to position the latching surface of the hooked projection in abutting engagement with the bottom side surface of the substrate positioned beneath the receiving surface.

15. The rocker-type support assembly of claim 10 wherein said means for affixing further comprises at least one rocker arm positioned proximate to and extending in a direction parallel to, the at least one retaining arm.

16. The rocker-type support assembly of claim 15 wherein the at least one rocker arm is of a length corresponding to the length of the at least one retaining arm.

17. The rocker-type support assembly of claim 16 wherein said at least one rocker arm further includes a rounded end portion for abutting against a top side of the receiving surface such that application of the twisting moment to the support body causes pivotal movement causing the rocking movement.

18. The rocker-type support assembly of claim 15 wherein said at least one rocker arm comprises first and second rocker arms, wherein a first rocker arm is positioned at a first side of the at least one retaining arm and a second rocker arm is positioned at a second side of the at least one retaining arm.

19. The rocker-type support assembly of claim 1 wherein said means for engaging with the face surface of the at least one actuation switch comprises a post member connected at a first end thereof to the bottom face surface and positioned at a second end thereof to abut against the face surface of the actuation switch.

20. A rocker support assembly for supporting a pair of poppel-type actuation switches at a receiving surface defined upon a housing having an opening extending therein, said rocker support assembly being adapted for positioning the pair of actuation switches at the opening and for transmitting an actuation force, alternately, to a first actuation switch or a second actuation switch of the pair of actuation switches responsive to application of a force thereto, said rocker support assembly comprising:

a support body defining a top face surface, a bottom face surface, and side edge surfaces, the bottom face surface of said support body having dimensions adapted for permitting positioning of the pair of actuation switches beneath said bottom face surface;

a first pair of pawl arms extending from the support body beneath opposing side edge surfaces of the support body and being adapted for engaging with the first actuation switch of the pair of actuation switches and to maintain the first actuation switch within a predetermined maximum distance beneath the bottom face surface of the support body;

a second pair of pawl arms extending from the support body beneath opposing side edge surfaces of the support body and being adapted for engaging with the second actuation switch of the pair of actuation switches and to maintain the second actuation switch within a predetermined maximum distance beneath the bottom face surface of the support body;

a pair of retaining arms extending beneath opposing side edge surfaces of the support body midway along the support body, each retaining am of said pair of retaining arms comprised of a shaft portion affixed at a top end thereof to the bottom face surface of the support surface, a central bight section formed along a bottom end portion of the shaft portion and a hooked projection having a latching surface extending beyond the central bight section, the latching surface being adapted for abutting against an inner sidewall of the housing thereby to retain in position the support body at the opening extending into the housing;

rocker arms positioned to extend beneath opposing side edge surfaces of the support body at opposite sides of each retaining arm of the pair of retaining arms facing both opposing ends of the support arm, each of the rocker arms having rounded end surfaces adapted for seating against a surface of the housing such that a twisting moment applied to the support body causes pivotal movement of the support body about pairs of rocker arms facing one of the opposing ends of the support body; and a pair of post members, each post member of the pair of post members being connected at a first end thereof to the bottom face surface of the support body, and positioned at a second end thereof to abut against a face surface of an actuation switch such that pivotal movement of the support body responsive to a twisting moment applied thereto actuates one of the actuation switches.

21. In a radio receiver having receiver circuitry housed within a housing, the housing having an opening extending therein and the receiver circuitry having at least one actuation switch forming a portion thereof, the actuation switch being responsive to application of an actuation force upon a face surface thereof, the housing and the at least one actuation switch being in combination with a rocker-type support assembly for supporting the at least one actuation switch at the opening extending into the housing, said rocker-type support assembly comprising:

a support body defining a top face surface and a bottom face surface and side edge surfaces, the bottom face body of said support surface having dimensions permitting positioning of the at least one actuation switch beneath said bottom face surface;

means extending from the support body beneath the bottom face surface and being engageable with the at least one actuation switch for maintaining the at least one actuation switch in a desired orientation relative to the support body;

means extending from the support body beneath the bottom face surface of the support body and engageable with the receiving surface for affixing the support body to the housing while permitting limited rocking movement of the support body thereabout upon application of a twisting moment to the support body; and means coupled to and extending beneath the bottom face surface of the support body for engaging the face surface of the actuation switch said means for engaging being operative to abut against the face surface of the actuation switch and to generate the actuation force to actuate the actuation switch responsive to times in which the twisting moment applied to the support body causes pivotal movement thereof in a first direction.

22. A method for supporting at least one actuation switch, at an opening formed to extend through a receiving surface, said at least one actuation switch being responsive to application of an actuation force upon a face surface thereof, said method comprising the steps of:

positioning and securing the at least one actuation switch to a support body beneath a bottom surface of the support body;

positioning a post member to extend beneath the bottom face surface of the support body such that a bottom end surface of the post member abuts against the face surface of the at least one actuation switch;

maintaining the at least one actuation switch in a desired orientation relative to the support body and to the post member extending therebeneath; and affixing the support body to the receiving surface such that the at least one actuation switch is positioned within the opening extending through the receiving surface while permitting limited rocking movement of the support body responsive to application of a twisting moment thereto, said rocking movement operative to cause the post member to engage with the at least one actuation switch to provide the actuation switch with the actuation force to actuate the actuation switch thereby.

* * * * *